US012656039B2

(12) United States Patent
Wang

(10) Patent No.: US 12,656,039 B2
(45) Date of Patent: Jun. 16, 2026

(54) MOLD FOR PREPARING ICE HOCKEY

(71) Applicant: Shenzhen Qima Technology Co., Ltd, Shenzhen (CN)

(72) Inventor: Xiaojun Wang, Shenzhen (CN)

( * ) Notice: Subject to any disclaimer, the term of this patent is extended or adjusted under 35 U.S.C. 154(b) by 74 days.

(21) Appl. No.: 18/623,095

(22) Filed: Apr. 1, 2024

(65) Prior Publication Data

US 2025/0305742 A1 Oct. 2, 2025

(30) Foreign Application Priority Data

Mar. 28, 2024 (CN) ..... 202420619383.X

(51) Int. Cl.
*F25C 1/22* (2018.01)

(52) U.S. Cl.
CPC ..... *F25C 1/22* (2013.01)

(58) Field of Classification Search
CPC .... F25C 1/22; F25C 1/24; F25C 1/243; F25C 1/25
See application file for complete search history.

(56) References Cited

U.S. PATENT DOCUMENTS 9,272,444 B2 * 3/2016 Zorovich ..... B29C 33/405
2007/0107447 A1 * 5/2007 Langlotz ..... F25C 1/243 62/340
2019/0293335 A1 * 9/2019 Bertolini ..... F25C 1/04

FOREIGN PATENT DOCUMENTS

DE 102022114359 A1 * 12/2023 ..... F25C 1/243

OTHER PUBLICATIONS

English language machine translation of DE102022114359 to Ligenza et al. translated Sep. 2025 (Year: 2023).*

* cited by examiner

*Primary Examiner* — Cassey D Bauer

(57) ABSTRACT

A mold for preparing ice hockey is disclosed, including a lower mold having a hemispherical structure; an upper mold fitted with the lower mold, and the upper mold being in a snap-fit connection with the lower mold; and a water injection column, fixedly provided on an end face of the upper mold away from the lower mold. Herein the water injection column is opened with a water injection hole, and an outer wall of the water injection column is provided with an air hole connected to the upper mold. By opening the water injection column hole on the water injection column and opening the air hole on the upper mold, when injecting water, air in the mold cavity can smoothly escape from the air hole, so that liquid can smoothly enter the mold cavity, thereby improving efficiency of water injection.

4 Claims, 5 Drawing Sheets

MOLD FOR PREPARING ICE HOCKEY

TECHNICAL FIELD

The present application relates to the technical field of ice hockey preparation, and in particular to a mold for preparing ice hockey.

BACKGROUND

Currently, production of ice hockey is generally carried out through a mold, by a mold closing to form a spherical mold cavity with a water injection port, and then to the mold cavity filled with water and the mold after injected with water is treated at low temperature to make the water in the mold freeze. After the water in the mold cavity is completely frozen, the mold is removed, and icicles formed by the water injection port on the ice hockey prepared may be removed.

However, in existing technologies, after the ice hockey is formed, it is inconvenient to take it out of the mold, and due to the water injection port of the mold has a small diameter, when filling water, air in the mold cavity cannot escape smoothly, resulting in negative pressure inside, which makes it impossible for the liquid to enter the mold cavity smoothly, thereby affecting efficiency of water injection.

SUMMARY

The present disclosure aims to provide a mold for preparing ice hockey, to address problems of inconveniently removing the ice hockey from the mold and inconveniently injecting water into the mold cavity smoothly in the existing technologies.

To achieve the above objectives, the present disclosure adopts the following technical solutions. In some embodiments of the present disclosure, a mold for preparing ice hockey is provided, including a lower mold having a hemispherical structure; an upper mold fitted with the lower mold, and the upper mold being in a snap-fit connection with the lower mold; and a water injection column, fixedly provided on an end face of the upper mold away from the lower mold. Herein the water injection column is opened with a water injection hole, and an outer wall of the water injection column is provided with an air hole connected to the upper mold.

In order to facilitate a connection between the lower mold and the upper mold, preferably, the lower mold is fixedly provided with a first connecting plate, and the upper mold is fixedly provided with a second connecting plate. An inner wall of the second connecting plate is fitted with an outer wall of the first connecting plate, and the outer wall of the first connecting plate is fixedly provided with a first sealing ring. An end face of the first sealing ring away from the first connecting plate is abutted against the inner wall of the second connecting plate.

In order to prevent accidental tipping, resulting in outflow of liquid in the mold cavity, preferably, the mold further includes a top cap set on the water injection column, and one end of the top cap is fixedly provided with a curved plate. An inner wall of the curved plate is fitted with an outer wall of the upper mold, and the curved plate is fixedly provided with a connecting column inside. The water injection column is opened with a connecting trough connected to the water injection hole, the connecting column is slidingly connected into the connecting trough, and an outer wall of the connecting column is fixedly provided with a second sealing ring.

In order to facilitate water injection into the mold cavity, preferably, the other end of the top cap is provided with a mounting groove, a top of the water injection column is slidingly connected into the mounting groove, and a bottom of the mounting groove is opened with a through hole connected to the connecting trough.

Preferably, the upper mold is made of transparent plastic, and the upper mold is fixedly provided with a water injection line.

Preferably, the lower mold is fixedly provided with a base at an end face thereon away from the first connecting plate.

Compared with the existing technologies, the mold for preparing ice hockey of the present disclosure has at least following beneficial effects and advantages.

1. Regarding the mold for preparing ice hockey of the present disclosure, by opening the water injection column hole on the water injection column and opening the air hole on the upper mold, when injecting water, air in the mold cavity can smoothly escape from the air hole, so that liquid can smoothly enter the mold cavity, thereby improving efficiency of water injection, and also reducing diameter of the water injection hole, so as to reduce diameter of icicles on the ice hockey that are formed due to the water injection port, and to improve roundness on surface of the ice hockey.

2. Regarding the mold for preparing ice hockey of the present disclosure, by fixedly setting the first connecting plate on the lower mold and fixedly setting the second connecting plate on the upper mold, it is convenient to have a combination between the upper mold and the lower mold. In this way, it is easy to assemble and disassemble, and also easy to demold. The lower mold is made of silicone, which is easy to peel the ice hockey out of the lower mold, further improving the demolding effect.

3. Regarding the mold for preparing ice hockey of the present disclosure, by setting the top cap on the upper mold, on one hand, it can be used as a funnel to improve the efficiency of water injection; on the other hand, by covering the top cap on the water injection column of the upper mold, the connecting column is slid into the connecting trough, and the curved plate is fitted with the upper mold to cover the air hole. In case of accidental tipping of the lower mold, due to the air hole being covered, the water will not leak immediately, thus improving effectiveness of use.

It should be noted that other unrelated parts of the mold for preparing ice hockey of the present disclosure are the same as the existing technologies or can be realized by using the existing technologies. In the present disclosure, by opening the water injection hole on the water injection column and opening the air hole on the upper mold, when injecting water, the air in the mold cavity can escape from the air hole smoothly, so that the liquid can enter the mold cavity smoothly, thus improving the efficiency of water injection. Moreover, by fixedly setting the first connecting plate on the lower mold and fixedly setting the second connecting plate on the upper mold, it is convenient to combine the upper mold with the lower mold, which is convenient to assemble and disassemble, and also easy to take off the mold.

Figure 1:
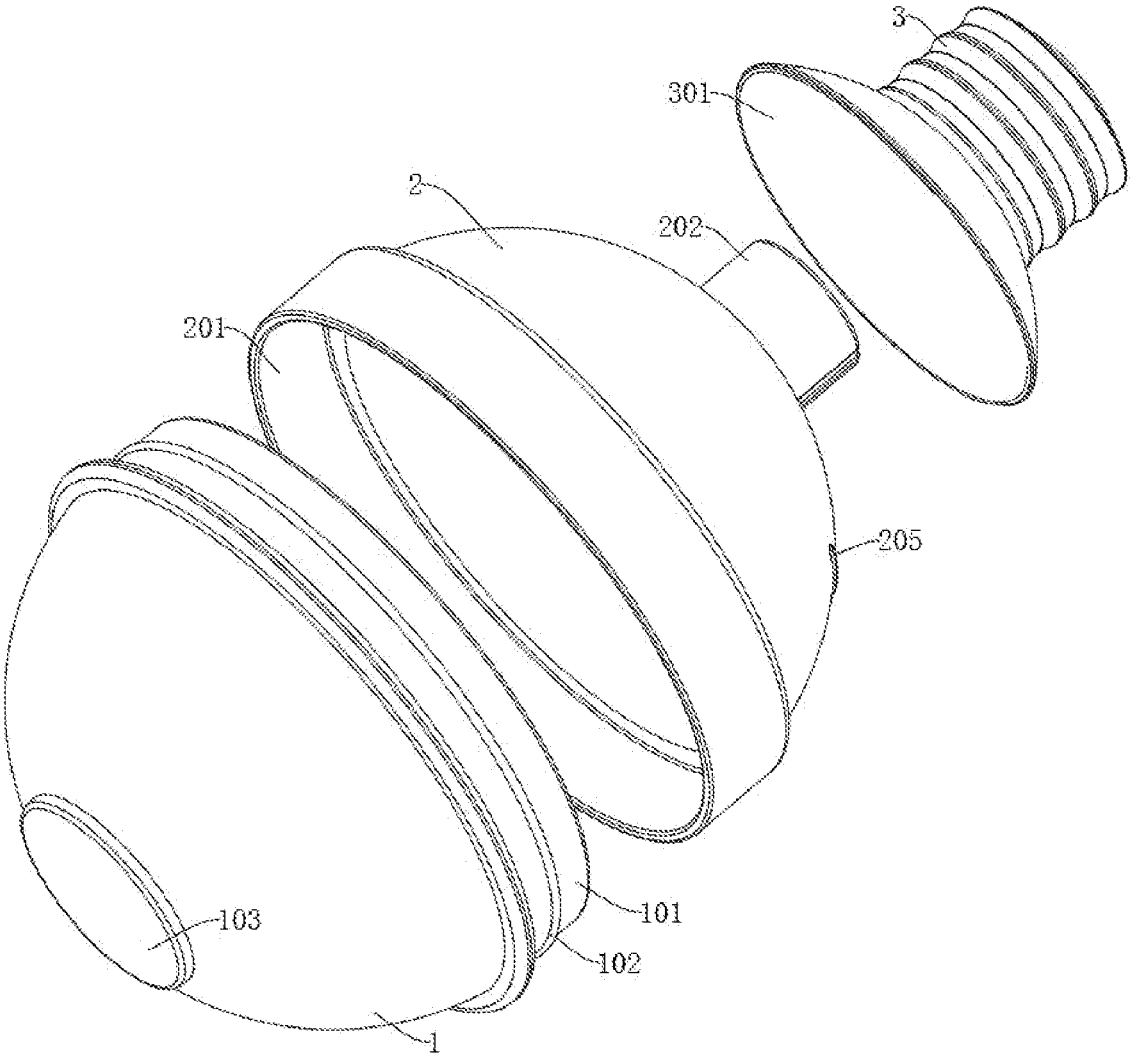
FIG. 1 shows a structural schematic diagram of a mold for preparing ice hockey in accordance with some embodiments of the present disclosure.

In the drawings, reference signs are as follows. 1. Lower mold, 101. First connecting plate, 102. First sealing ring, 103. Base, 2. Upper mold, 201. Second connecting plate, 202. Water injection column, 203. Water injection hole, 204. Air hole, 205. Water injection line, 3. Top cap, 301. Curved plate, 302. Mounting groove, 303. Connecting column, 304. Second sealing ring.

DETAILED DESCRIPTION OF THE EMBODIMENTS

The technical solutions in the embodiments of the present disclosure will be clearly and completely described below in conjunction with accompanying drawings in the embodiments of the present disclosure. Obviously, described embodiments are only a part of the embodiments of the present disclosure and not all of the embodiments of the present disclosure.

In the description of the present disclosure, it is to be understood that terms "up", "below", "front", "rear", "left", "right", "top", "bottom", "inside", and "outside", and the like indicate orientation or positional relationships are based on those shown in the accompanying drawings, and are intended only for the purpose of facilitating the description of the present disclosure and simplifying the description, but are not indicated or implied that a device or an element referred to must have a particular orientation, be constructed and operated in a particular orientation, and therefore it cannot be construed as a limitation of the present disclosure.

Embodiments

Referring to FIG. 1 to FIG. 4, in some embodiments of the present disclosure, a mold for preparing ice hockey is provided, including a lower mold 1 having a hemispherical structure, and the lower mold 1 is made of plastic, silicone or stainless steel. Herein the lower mold 1 is preferred made of silicone, which is a soft material and is convenient to peel the ice hockey out of the lower mold 1, thereby improving demolding effect. Moreover, the mold for preparing ice hockey further includes an upper mold 2 fitted with the lower mold 1, and the upper mold 2 also has the hemispherical structure. The upper mold 2 is in a snap-fit connection with the lower mold 1, herein the snap-fit connection may be through a buckle or a snap etc. to connect the upper mold 2 to the lower mold 1. In actual use cases, the lower mold 1 is fixedly provided with a first connecting plate 101, the upper mold 2 is fixedly provided with a second connecting plate 201, and the second connecting plate 201 is covered on the first connecting plate 101. And meanwhile, an inner wall of the second connecting plate 201 is fitted with an outer wall of the first connecting plate 101. To further improve sealing effect, the outer wall of the first connecting plate 101 is fixedly provided with a first sealing ring 102. The first sealing ring 102 is provided with one set to five sets, preferably one set. And an end face of the first sealing ring 102 away from the first connecting plate 101 is abutted against the inner wall of the second connecting plate 201. When in use, by fixedly providing the first connecting plate 101 on the lower mold 1 and fixedly providing the second connecting plate 201 on the upper mold 2, which facilitates a combination between the upper mold 2 and the lower mold 1, it is easy to assemble and disassemble, and also easy demolding. Due to the lower mold 1 is made of silicone, which makes it easy to peel the ice hockey out of the lower mold 1, thereby further improving the demolding effect. In addition, the mold for preparing ice hockey further includes a water injection column 202, which is fixedly provided on an end face of the upper mold 2 away from the lower mold 1. Herein the water injection column 202 is opened with a water injection hole 203, and an outer wall of the water injection column 202 is provided with an air hole 204 connected to the upper mold 2. Air in the mold cavity can be discharged from the mold cavity through the air hole 204 during water injection, which is convenient to go through the water injection hole 203 for water injection. At the same time, the diameter of the water injection hole 203 can be reduced, so that a diameter of icicle formed on the ice hockey due to the water injection hole can be reduced. On the one hand, it can improve the roundness of a surface of the ice hockey and improve precision of the ice hockey; on the other hand, it is easy to remove the ice hockey and improve the use of the ice hockey. An axis of the air hole 204 is parallel to the axis of the water injection column 202, and when the water injection hole 203 above the upper mold 2 is in a frozen state, water can overflow from the water injection hole 203, reducing the risk of mold rupture.

When in use, by opening the water injection column 203 on the water injection hole 202 and opening the air hole 204 on the upper mold 2, air in the mold cavity can smoothly escape from the air hole 204 when injecting water, so that liquid can smoothly enter the mold cavity, thereby improving water injection efficiency. Furthermore, by fixedly providing the first connecting plate 101 on the lower mold 1 and fixedly providing the second connecting plate 201 on the upper mold 2, which is conveniently a combination between the upper mold 2 and the lower mold 1. Thus, it is convenient to assemble and disassemble, and also easy to demold. Due to the lower mold 1 is made of silicone, which makes it convenient to peel the ice hockey from the lower mold 1, thereby further improving the demolding effect.

Referring to FIG. 1, FIG. 2, FIG. 4 and FIG. 5, the mold for preparing ice hockey of the present disclosure further includes a top cap 3 set on the water injection column 202, and one end of the top cap 3 is fixedly provided with a curved plate 301. An inner wall of the curved plate 301 is fitted with an outer wall of the upper mold 2, and the curved plate 301 is fixedly provided with a connecting column 303 inside. The water injection column 202 is opened with a connecting trough connected to the water injection hole 203, the connecting column 303 is slidingly connected into the connecting trough, and an outer wall of the connecting column 303 is fixedly provided with a second sealing ring 304. When in use, the top cap 3 is covered on the water injection column 202 of the upper mold 2, so that the connecting column 303 is slidingly connected into the connecting trough, the curved plate 301 is fitted with the upper mold 2, so that the air hole 204 can be covered. When the lower mold 1 is accidentally tipped over, water will not leak immediately because the air hole 204 is covered, thereby improving the use effect.

Figure 5:
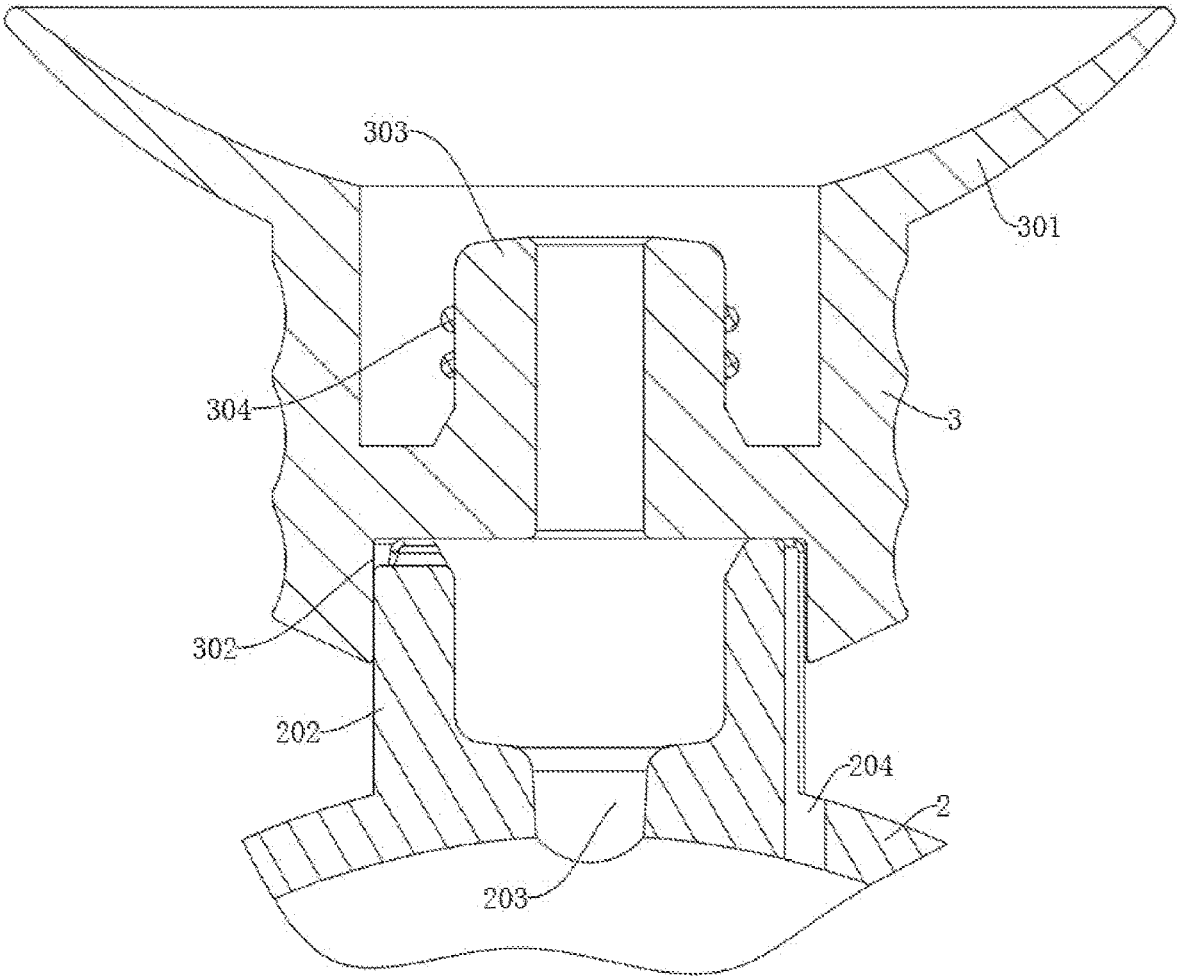
FIG. 5 shows a structural schematic diagram of a top cap of the mold for preparing ice hockey in accordance with some embodiments of the present disclosure.

Referring to FIG. 5, the other end of the top cap 3 is provided with a mounting groove 302, a top of the water injection column 202 is slidingly connected into the mounting groove 302, and a bottom of the mounting groove 302 is opened with a through hole connected to the connecting trough. When in use, by turning the top cap 3 upside down, at this time the top cap 3 is similar to a funnel to facilitate water being injected into the mold cavity, thereby further improving the water injection efficiency.

Figure 2:
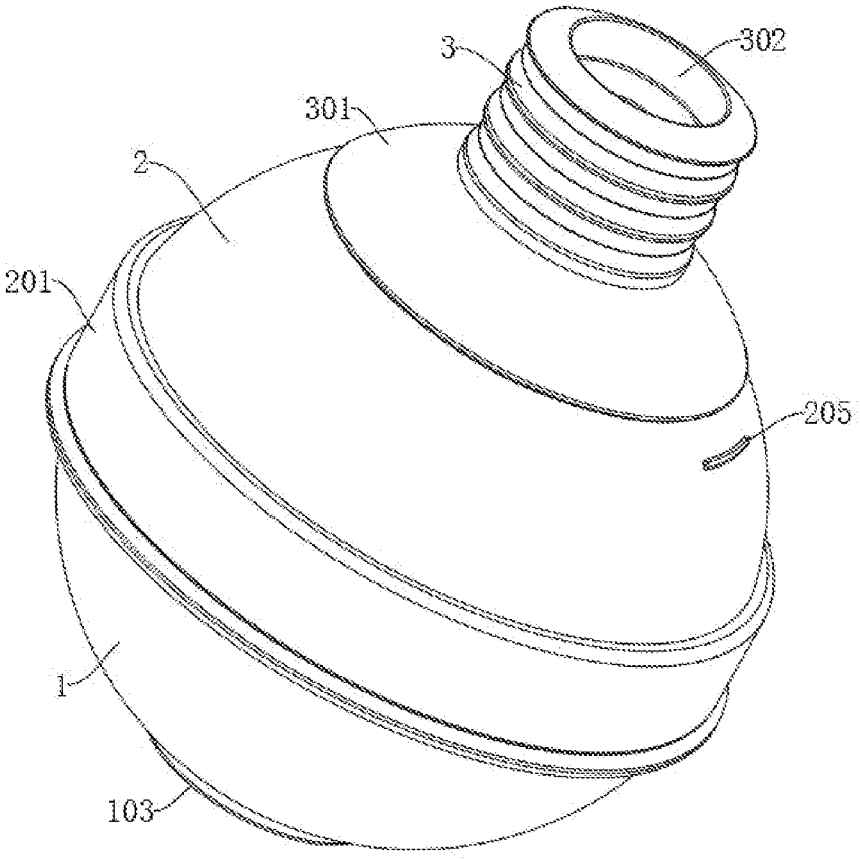
FIG. 2 shows another structural schematic diagram of the mold for preparing ice hockey in accordance with some embodiments of the present disclosure.
Figure 3:
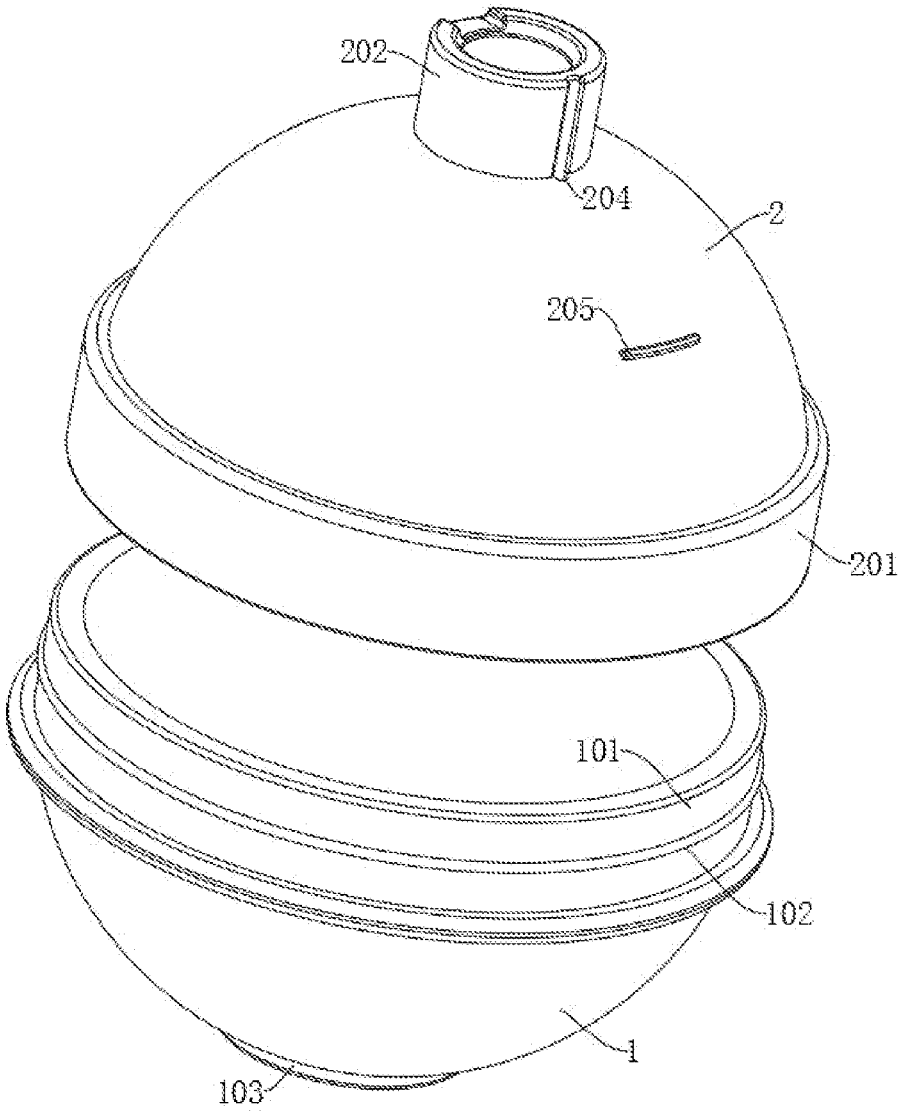
FIG. 3 shows still another structural schematic diagram of the mold for preparing ice hockey in accordance with some embodiments of the present disclosure.
Figure 4:
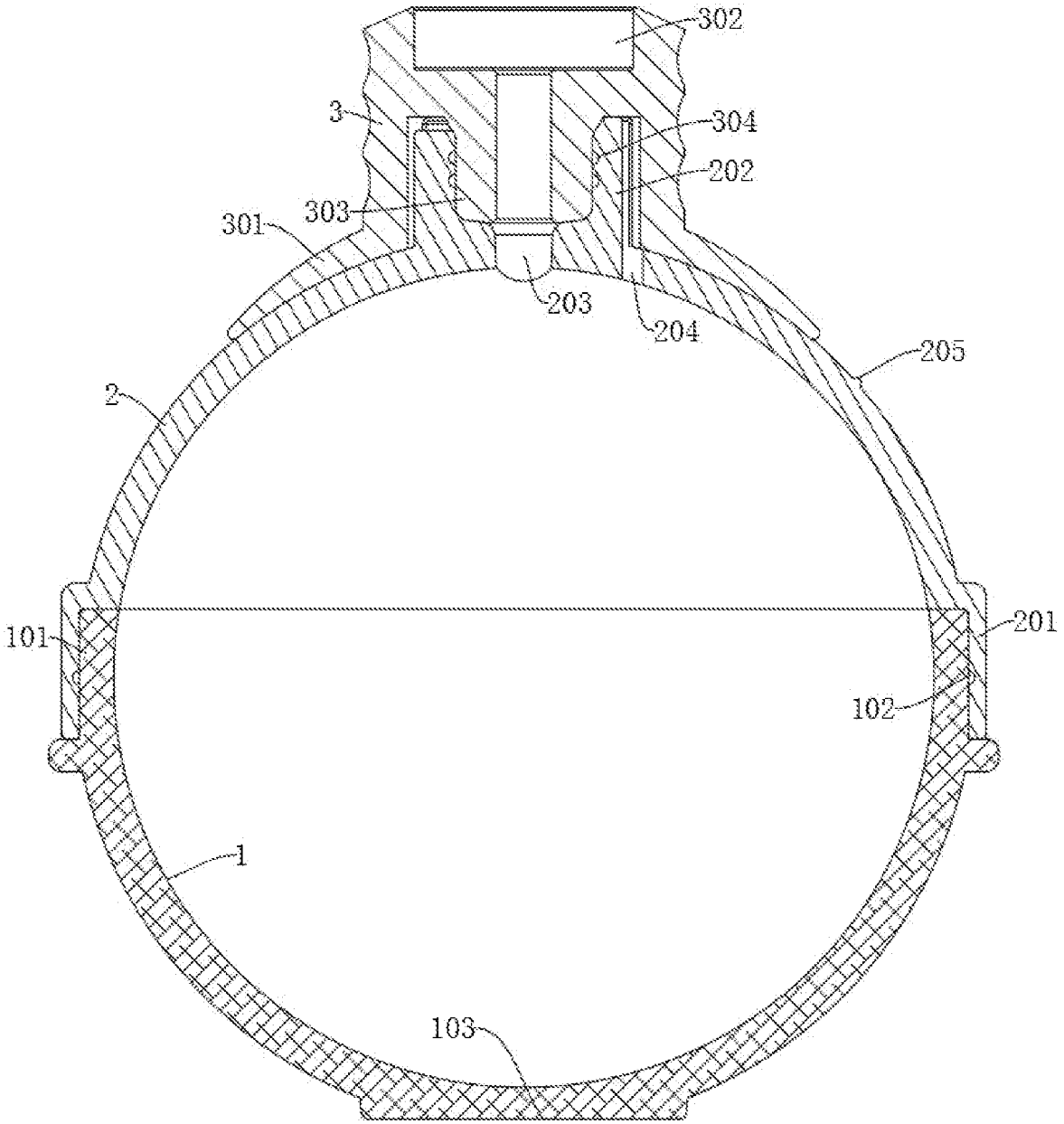
FIG. 4 shows a sectional view of the mold for preparing ice hockey in accordance with some embodiments of the present disclosure.

Referring to FIG. 2 and FIG. 3, the upper mold 2 may be made of plastic, stainless steel or silicone. Herein the upper mold 2 is preferably made of transparent plastic. The upper mold 2 is fixedly provided with a water injection line 205. When in use, by selecting the upper mold 2 be made of transparent plastic, it is easy to observe a height of a liquid level in the mold cavity, and the water injection line 205 is fixedly provided on the upper mold 2, which can further improve water injection precision.

Referring to FIG. 1 to FIG. 4, the lower mold 1 is fixedly provided with a base 103 at an end face thereon away from the first connecting plate 101. When in use, by fixedly providing the base 103 at the bottom of the lower mold 1, it facilitates a horizontal placement and thereby improving fixation effect.

The foregoing description is only a preferred specific implementation of the present disclosure, but the scope of protection of the present disclosure is not limited thereto. Any skilled person in the art that is familiar with this technical field, within the technical scope disclosed by the present disclosure, according to the technical solutions of the present disclosure and its concept to replace or change the equivalent, should be covered by the scope of protection of the present invention.

What is claimed is:

1. A mold for preparing ice hockey, comprising a lower mold having a hemispherical structure;

an upper mold fitted with the lower mold, and the upper mold being in a snap-fit connection with the lower mold; and a water injection column, fixedly provided on an end face of the upper mold away from the lower mold;

wherein the water injection column is opened with a water injection hole, and an outer wall of the water injection column is provided with an air hole connected to the upper mold;

wherein the lower mold is fixedly provided with a first connecting plate, and the upper mold is fixedly provided with a second connecting plate;

wherein an inner wall of the second connecting plate is fitted with an outer wall of the first connecting plate, and the outer wall of the first connecting plate is fixedly provided with a first sealing ring;

wherein an end face of the first sealing ring away from the first connecting plate is abutted against the inner wall of the second connecting plate;

wherein the mold for preparing ice hockey further comprises a top cap set on the water injection column, and one end of the top cap is fixedly provided with a curved plate;

wherein an inner wall of the curved plate is fitted with an outer wall of the upper mold, and the curved plate is fixedly provided with a connecting column inside; and wherein the water injection column is opened with a connecting trough connected to the water injection hole, the connecting column is slidingly connected into the connecting trough, and an outer wall of the connecting column is fixedly provided with a second sealing ring.

2. The mold for preparing ice hockey according to claim 1, wherein the other end of the top cap is provided with a mounting groove, a top of the water injection column is slidingly connected into the mounting groove, and a bottom of the mounting groove is opened with a through hole connected to the connecting trough.

3. The mold for preparing ice hockey according to claim 1, wherein the upper mold is made of transparent plastic, and the upper mold is fixedly provided with a water injection line.

4. The mold for preparing ice hockey according to claim 1, wherein the lower mold is fixedly provided with a base at an end face thereon away from the first connecting plate.

* * * * *